US005077861A

United States Patent [19]

Bokat

[11] Patent Number: 5,077,861

[45] Date of Patent: Jan. 7, 1992

[54] HOSE CLEANER

[76] Inventor: Charles Bokat, 328 Nemacolin Way, Carmichaels, Pa. 15320

[21] Appl. No.: 632,755

[22] Filed: Dec. 24, 1990

[51] Int. Cl.[5] ..... A47L 7/04

[52] U.S. Cl. ..... 15/256.5; 15/88; 15/88.1; 15/104.04

[58] Field of Search ..... 15/256.5, 104.04, 88, 15/88.1, 210 B, 302; 134/199, 122

[56] References Cited

U.S. PATENT DOCUMENTS

| | | | |
|---|---|---|---|
| 3,530,526 | 9/1970 | Schmidt | 15/88 X |
| 3,531,059 | 9/1970 | Walker | 15/88 X |
| 4,503,577 | 3/1985 | Fowler | 15/88 |
| 4,543,683 | 10/1985 | Goldman | 15/210 B X |
| 4,734,950 | 4/1988 | Schenke et al. | 15/104.04 X |
| 4,995,749 | 2/1991 | Gornik | 134/199 X |

*Primary Examiner*—Chris K. Moore
*Attorney, Agent, or Firm*—Daniel Ernsberger

[57] ABSTRACT

This invention relates to a hose cleaner. It is a bisected cylinder with parts hinged together and having means for retention of the parts in closed position. Brushes are applied to the interior parts of the cylinder and the free ends of the brushes form a cylindrical opening when the parts are closed. A pipe is used as means for introducing water near one end of the bisected cylinder. The water flows freely over the brush. A portion of the water is directed to flow in the same direction as the hose as it is pulled through the cylinder (co-current flow) and a second portion of the water flows in a direction opposite to the direction of the hose as it is pulled through the cylinder (countercurrent flow).

1 Claim, 1 Drawing Sheet

HOSE CLEANER

BACKGROUND OF THE INVENTION

This invention relates to a hose cleaner. It is designated brush and scour hoses, clothes lines, cables and other related articles of manufacture. Prior inventions in this field comprise a bisected cylinder with the parts hinged together and brushes applied to the interior of the parts of the cylinder to permit the passage of the hose line or cable centrally through the cylinder. The brushes clean the hose line or cable as it passes through the cylinder. See U.S. Pat. No. 946,370. This design is prone to clogging by dirt that accumulates within the device. Other patents have a source of water which flows freely over the brush surface to carry away the dirt. See U.S. Pat. No. 810,548. The present invention offers a new design to promote cleaning and reduce clogging.

SUMMARY OF THE PRESENT INVENTION

This invention relates to a bisected cylinder with parts hinged together and having means for retention of the parts in closed position. Brushes are applied to the interior parts of the cylinder and the free ends of the brushes form a cylindrical opening when the parts are closed. A pipe is used as means for introducing water near one end of the bisected cylinder. The water flows freely over the brush. A portion of the water is directed to flow in the same direction as the hose as it is pulled through the cylinder (co-current flow) and a second portion of the water flows in a direction opposite to the direction of the hose as it is pulled through the cylinder (countercurrent flow).

GENERAL DESCRIPTION OF THE DRAWINGS

DETAILED DESCRIPTION OF THE INVENTION

Figures 1, 2, 3, 4:
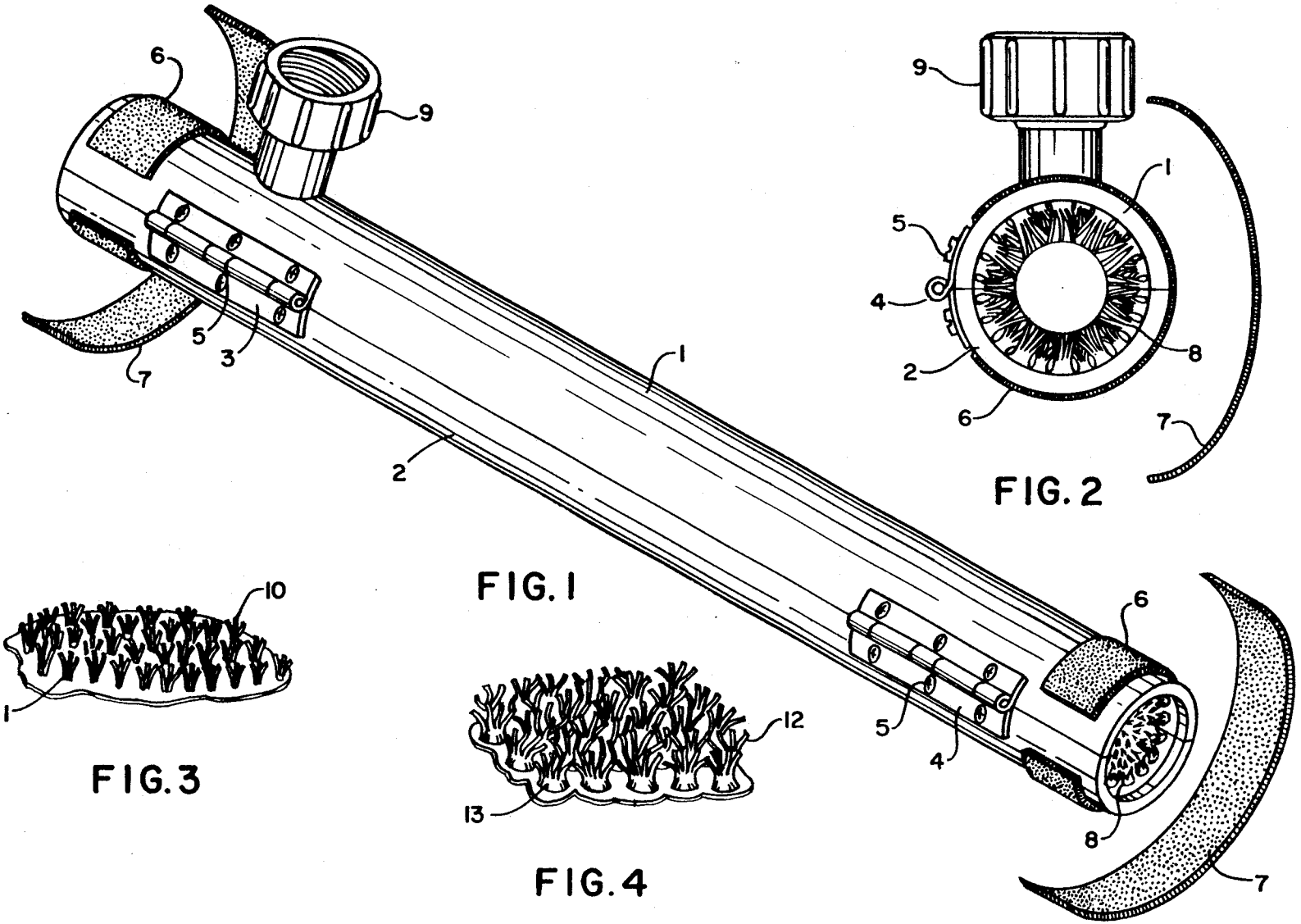
FIG. 1 is a perspective view of the present invention.
FIG. 2 is an orthogonal end view of the invention.
FIG. 3 shows a preferred brush design with flat bristles.
FIG. 4 shows the most preferred brush design with flat, curved bristles supported by a cup like portion.

In FIG. 1, numbers (1) and two (2) of the bisected halves of the cylinder. Numbers three (3) and four (4) are hinges fastened to the bisected cylinder with screws; number five (5). Numbers six (6) and seven (7) are two pieces of VELCRO used as is the means for retaining the bisected cylinder in closed position. Number eight (8) is the brush material. Number nine (9) is a garden hose coupling used as means for introducing water into the bisected cylinder.

One form of the brush material is shown in FIG. 2. In this drawing the bristles ten (10) are flat and straight and clustered together at the base eleven (11).

A second and more preferred brush material is shown in FIG. 4. It consists of a cluster of thin, flat, twisted or curved projections, twelve (12), connected in a circle to a cup-like portion, thirteen (13).

In the ordinary use of this invention, the two halves to the cylinder are separated and closed around the hose, clothes line, cable or other related article of manufacture. The water is turned on and the invention is tilted so that the water will flow along its length. The hose, cloths line or cable is pulled through the cylindrical opening along the axis of the invention. The invention works most effectively when the hose, cloths line or cable enters the invention at the end far from the source of water, and exits the invention where the source of water is introduced. When the hose is pulled through the invention in this manner, it creates a lengthy counter-current flow of water in the first portion of the invention and a relatively short co-current flow of water in the second portion of the invention. This assists the cleaning process. It is possible to pass the hose, cloths line or cable in the opposite direction but the advantages of thorough cleaning without clogging are not fully met.

The material of the brushes used according to this invention can be any material which is sufficiently stiff so that the brushing action against the hose, cloths line or cable will cause removal of the dirt. Common commercially available indoor outdoor carpeting with cylindrical bristles is an adequate brush material. The preferred brush material is the artificial grass material with flat straight bristles, or flat curved bristles. The most preferred brush material is an artificial grass material that consists of a cluster of thin projections connected in a circle to a cup-like portion. The thin projections are approximately one half inch in length and are textured to be flat and twisted or bent so that they assume the random, haphazard shape of natural grass blades. The cup portions are spaced on one half inch centers over the surface of the brush material. One variation of this kind of artificial grass is manufactured under U.S. Pat. No. 3,590,109. This kind of artificial grass material, when used as a brush, substantially improves the water flow and cleaning action of the invention so as to obtain a clean product without clogging of the invention.

It is preferred that the cylindrical opening formed by the free ends of the bristles of the brush be uniform in diameter throughout the length of the invention. The brush material can be removed and replaced as needed.

I claim:

1. A hose cleaner comprising a bisected cylinder with parts hinged together; means for retention of the parts in closed position; brushes applied to the interior parts of the cylinder so that the free ends of the bristles form a cylindrical opening when the parts are closed; and means for introducing water into the cylinder opening near one end of the bisected cylinder; and wherein the bristles of the brush each comprise a cluster of thin, flat, twisted, and curved projections, connected in a circle to a cup-like portion.

* * * * *